US006213624B1

(12) United States Patent
Lin

(10) Patent No.: US 6,213,624 B1
(45) Date of Patent: Apr. 10, 2001

(54) STRUCTURE OF THE NET LAMP STRING

(76) Inventor: Fong Shi Lin, No. 196, Chin Long Road, Hsio Chin Ko Chang, Hwei Chou City, Kaunton (TW)

( * ) Notice: Subject to any disclaimer, the term of this patent is extended or adjusted under 35 U.S.C. 154(b) by 0 days.

(21) Appl. No.: 09/334,672

(22) Filed: Jun. 17, 1999

(51) Int. Cl.[7] ..... F21V 21/00

(52) U.S. Cl. ..... 362/249; 362/123; 362/252; 362/806

(58) Field of Search ..... 362/249, 252, 362/806, 238, 123, 227

(56) References Cited

U.S. PATENT DOCUMENTS 5,601,361 * 2/1997 Lawrence ..... 362/238
5,632,550 * 5/1997 Yeh ..... 362/123
5,716,124 * 2/1998 Hsu ..... 362/252
6,149,284 * 11/2000 Wang ..... 362/249

* cited by examiner

*Primary Examiner*—Stephen Husar
*Assistant Examiner*—John Anthony Ward
(74) *Attorney, Agent, or Firm*—Rosenberg, Klein & Lee

(57) ABSTRACT

The present invention relates to a new structure of the net lamp string, which mainly includes a group of cross-layout base grid net to provide a lamp string with linear shape to be laid according to the arrangement of grid net. It utilizes a proper jig to fix the connection of electrical wires and net wires at every cross points, and attaches the lamp strings to a fixed position. Thus, it can simply and easily be assembled as a firm structure of the net lamp string, and it can be extended serially to obtain the best effectiveness.

2 Claims, 2 Drawing Sheets

STRUCTURE OF THE NET LAMP STRING

BACKGROUND OF THE INVENTION

Currently, in order to achieve the better decoration effect of lamps, the makers of the decoration lamp develop a structure of net lamp string which demonstrate the bright and pretty light-shining by using many lamp strings lightening simultaneously to obtain the shining effect. Conventional structure mainly utilizes the mutual clip-windings of lamp string wires to assemble as the configuration with net shape; and the weight of whole body is all supported by the original electrical wires while overhanging. Therefore, besides the trouble and inconvenience while manufacturing, it also easily results to the trouble of the loosening of lamp string and electrical wires, and creates the shortcoming of the bad contact or non-lightening of lamp string.

OBJECT OF THE INVENTION

Owing to this, the main object of the present invention is to provide a new structure of the net lamp string. It provides the ordinary lamp strings of linear shape to be simply and easily connected by using jig by a base grid net with high strength. It shows a grid net lamp string with specialty that can have simple and convenient production and assembly, and also it needs not to worry about the bad phenomena as loosening of lamp group and electrical wires. Thus, it is full with practical effectiveness. Now, by fitting with the drawings, the structure and features of the present invention are described as the following:

DETAILED DESCRIPTION OF THE INVENTION

Figure 1:
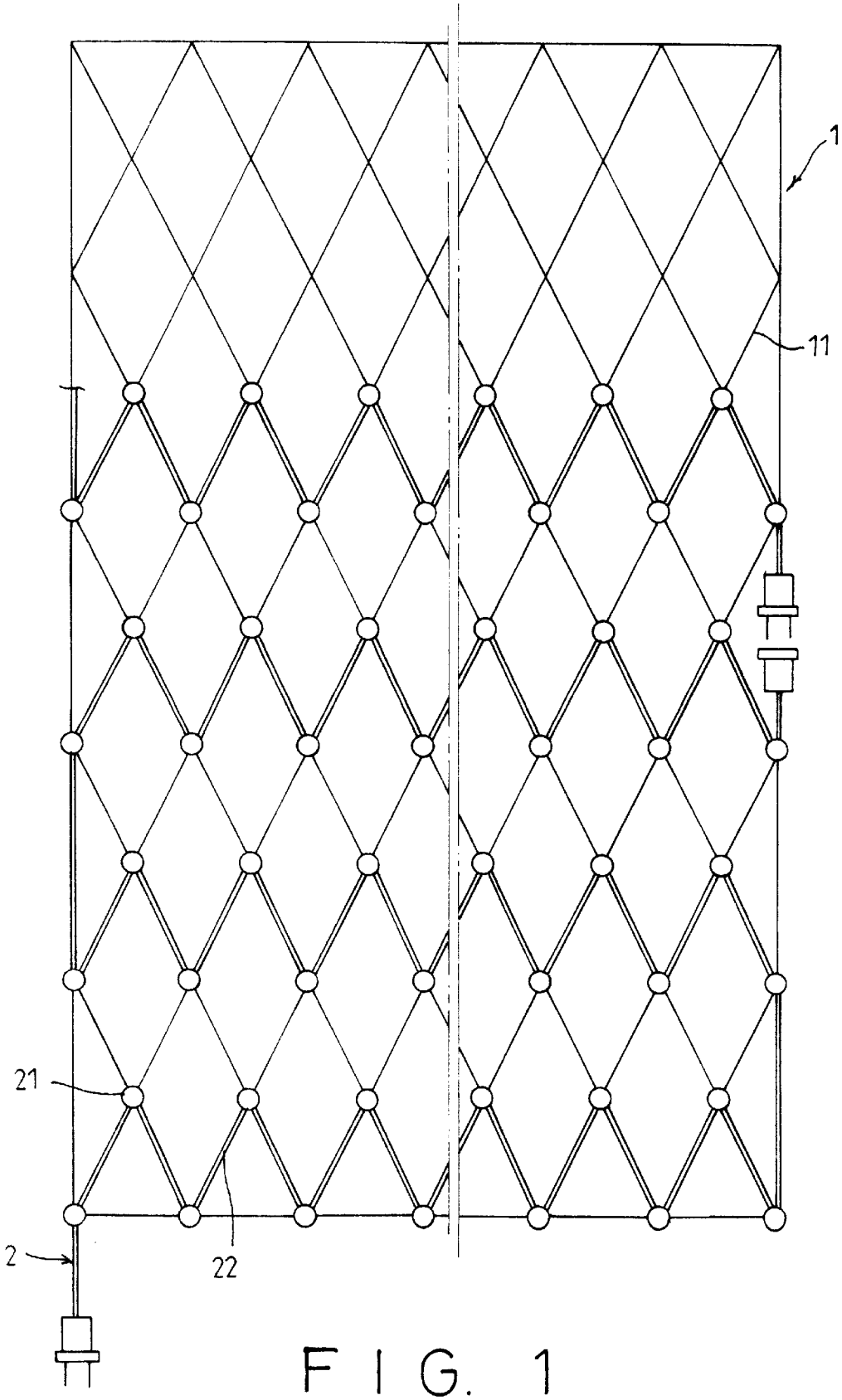
FIG. 1 is a schematic diagram of implementation status of the present invention.
Figure 2:
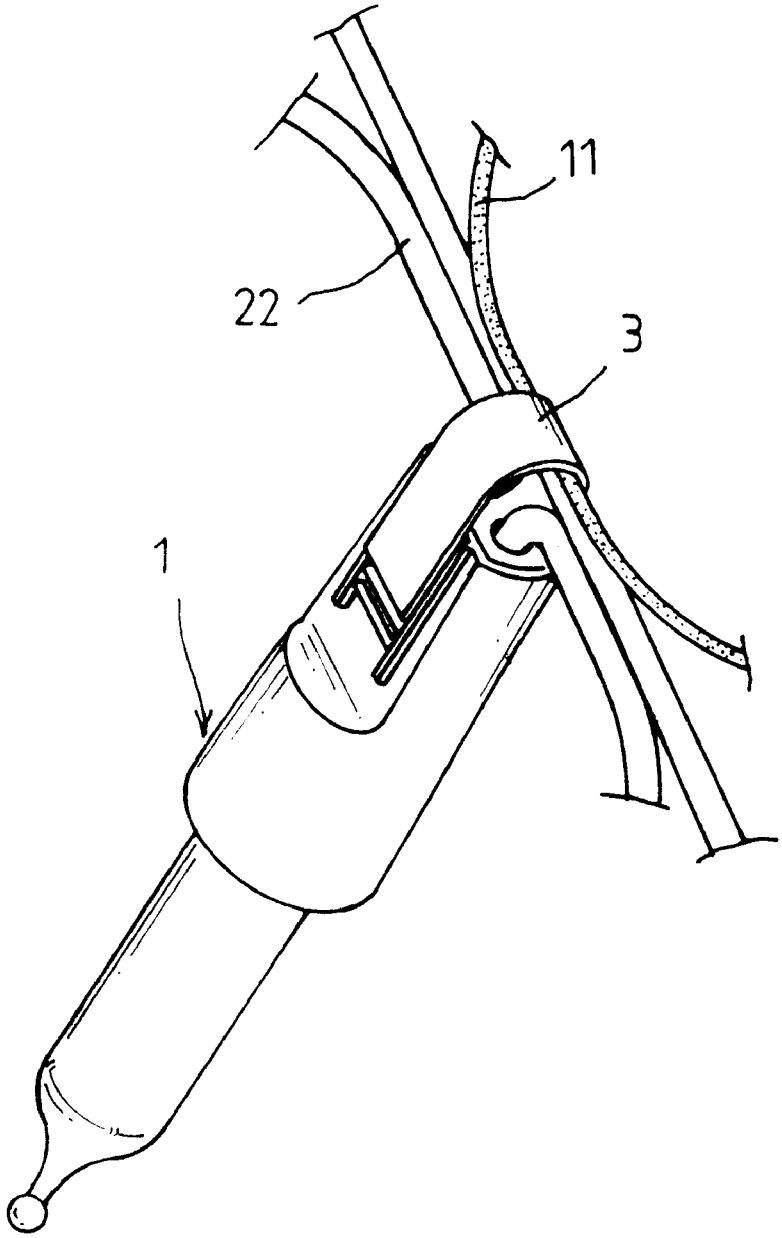
FIG. 2 is a three dimensional assembling diagram of the lamp string and grid net wires of the present invention.

Please refer to those shown in FIGS. 1, 2, the present invention mainly includes a base grid net (1) of a main body of net shape which is made of the plastic line material with high strength, for example, a structure like fish net to form a series of structure with net shape. By using this base grid net (1) as a structural body, it can use a jog (3) to simply assemble each lamp group (21) of the ordinary lamp string (2) of linear shape at the cross points of net wires (11) of the grid net (1); and the electrical wires (22) just parallel arrange along net wires (11). In the above described connecting structure, it is able to use multiple serial-connecting lamp strings to connect mutually, such that distribute the lamp group (21) at every cross points of grid net on the base grid net (1) to form a assembling structure of net lamp string.

While using, the overhang decoration mainly supports the weight of whole body by a base grid net (1), therefore the electrical wires and lamp groups will have no shortcomings as loosening or falling off. Furthermore, it can use the ordinary lamp strings of linear shape to finish a net lamp string under an implementation of simple clamp-connection. It needs not to use the tedious procedure of clip-winding wires as the conventional one, and it can simplify the process. Therefore, the present invention apparently can improve the prominent effectiveness, which is unable to be done by the conventional one. The present invention can fit with the positive conditions for patent, thus we file the application according to the law.

What is claimed is:

1. A net lamp string structure comprising:

a base net formed of a plurality of intersecting high strength plastic lines, each intersection defining a node of said base net; and, at least one light string having a plurality of lamp assemblies electrically connected together, each of said plurality of lamp assemblies being secured to said base net at a respective one of said nodes.

2. The net lamp string structure as recited in claim 1 where said base net has a fish net configuration.

* * * * *